US005186669A

United States Patent [19]

Holman et al.

[11] Patent Number: 5,186,669

[45] Date of Patent: Feb. 16, 1993

[54] INCANDESCENT LAMP

[75] Inventors: Michael R. Holman; Richard A. Smith, Jr., both of Sparta, Tenn.

[73] Assignee: Cooper Industries, Inc., Houston, Tex.

[21] Appl. No.: 473,357

[22] Filed: Feb. 1, 1990

[51] Int. Cl.[5] ..... H01J 9/395; H01J 9/26

[52] U.S. Cl. ..... 445/16; 445/17; 445/27; 445/43

[58] Field of Search ..... 445/16, 17, 22, 27, 445/32, 43, 53, 70

[56] References Cited

U.S. PATENT DOCUMENTS

| | | | |
|---|---|---|---|
| 2,491,237 | 12/1949 | Way | 445/27 |
| 2,556,059 | 6/1951 | Braunsdorff | 445/43 |
| 3,301,623 | 1/1967 | Preziosi et al. | 445/43 |
| 3,462,209 | 9/1969 | Fridrich | 445/27 |
| 3,904,908 | 9/1975 | Wolfe et al. | 445/32 |
| 4,052,638 | 10/1977 | Love et al. | 445/22 |
| 4,749,901 | 6/1988 | Demas | 313/315 |

FOREIGN PATENT DOCUMENTS

| | | | |
|---|---|---|---|
| 0202625 | 12/1982 | Japan | 445/53 |
| 0253744 | 11/1986 | Japan | 445/16 |
| 0248033 | 10/1988 | Japan | 445/53 |

*Primary Examiner*—Richard K. Seidel
*Assistant Examiner*—Jeffrey T. Knapp
*Attorney, Agent, or Firm*—A. Triantaphyllis

[57] ABSTRACT

A method of manufacturing an incandescent lamp and a lamp produced by such method are disclosed. An inert gas is injected to the interior of the lamp through an injection tube to displace substantially all of another gas and to remove the said another gas from the interior of the lamp. The lamp is sealed by press sealing the base of the lamp to trap the inert gas in the interior of the lamp.

7 Claims, 2 Drawing Sheets

INCANDESCENT LAMP

TECHNICAL FIELD OF THE INVENTION

The present invention relates to the field of incandescent lamps and, more particularly, to the field of incandescent lamps having a press-sealed base. Still more particularly, the present invention relates to a method of preparing an incandescent lamp wherein an inert gas is injected into the lamp to displace other gases present therein prior to press-sealing the base of the lamp.

BACKGROUND OF THE INVENTION

Incandescent lamps having a press-sealed base are well known in the art. Examples of such lamps are disclosed in U.S. Pat. Nos. 4,243,907, 4,603,278 and 4,749,901. U.S. Pat. No. 4,243,907 discloses a lamp having a sealed envelope with a press-seal at one end. The press-seal has removable portions to reduce the width of the press-seal.

U.S. Pat. No. 4,603,278 discloses an electric lamp having a sealed, light-transmitting glass envelope comprising a bulbous portion and a press-sealed end portion. One or more filaments are located within the interior of the bulbous portion. Lead-in conductors are connected to the filament or filaments. Each conductor is sealed within the press-sealed end portion of the envelope and projects exteriorly of the envelope. The lamp includes an electrically insulating base member having an opening for receiving the press-sealed end portion of the envelope and a protruding section for being positioned within an electrical socket. The base member includes flexure means for enabling the opening that receives the press-sealed end portion to expand during the insertion of the press-sealed end portion of the envelope into the base member.

U.S. Pat. No. 4,749,901 discloses a lamp and a method of preparing the same. The lamp has a bulbous portion and a flattened base. The method of manufacturing the lamp includes the steps of evacuating the lamp through a hollow space formed in the flattened base, press-sealing the flattened base of the lamp with press jaws whose pressing surface is substantially flat and flowing a cooling gas through the hollow space while maintaining the patency of the hollow space. The patent discloses an improvement wherein relief grooves on the surface of the press jaws are eliminated. The lamp includes at least one filament and corresponding electrical connections. The electrical connections are press-sealed in the flattened base. Furthermore, the lamp includes a support collar for positioning the incandescent lamp in a socket.

In the past, incandescent lamps were manufactured by providing a glass envelope having an open end; inserting a mount assembly comprising a filament or filaments and corresponding lead-in conductors or wires to the interior of the envelope with sections of the conductors extending to the exterior of the lamp; inserting a glass or other tube into the interior of the envelope through the open end; press-sealing a portion of the envelope around the tube and the conductors; evacuating the interior of the envelope through the tube following the press-sealing step, flowing an inert gas or gases into the interior of the envelope following the evacuating step; and closing the inlet of the tube to prevent the flow of the inert gas out of the lamp or the flow of undesirable gases into the lamp through said tube.

The manufacturing process for making miniature incandescent lamps suitable for use in automobiles by Wagner Lighting Products, a Division of Cooper Industries, Inc., is now described to illustrate a method of making an incandescent lamp which has been used heretofore. Referring to FIG. 1, there is shown a pre-formed glass envelope 10 having a bulbous portion 12 and a tubular portion 14 extending from bulbous portion 12. A mount assembly 15 including filaments 16 and 18 is inserted into the interior of envelope 10. Lead-in conductors 20 and 22 are connected to the ends of filament 16 and lead-in conductors 24 and 26 are connected to the ends of filament 18. Lead-in conductors 20, 22, 24 and 26 pass through bridge 28 which maintains the lead-in conductors in a spaced-apart relationship to one another. The end portions of lead-in conductors 20, 22, 24 and 26 which are not connected to filaments 16 and 18 extend to the exterior of envelope 10 through tubular portion 14. Mount assembly 15 which is comprised of filaments 16 and 18, lead-in conductors 20, 22, 24 and 26, and bridge 28 is preassembled prior to its insertion into envelope 10.

A glass exhaust tube 30 having a tube inlet 32 and tube outlet 34 is axially inserted into tubular portion 14. Heat is applied to tubular portion 14 to make it suitable for press-sealing. After heating and while a cooling gas is flowing through exhaust tube 30, the bottom section of tubular portion 14 is compressed by press jaws (not shown) to form a press-sealed base (shown in FIG. 2) around exhaust tube 30 and lead-in conductors 20, 22, 24 and 26. The press-sealed base so formed extends from the bottom end of envelope 10 which was previously defined by the open end of tubular portion 14 to immediately adjacent the mouth of tube outlet 34 without sealing tube outlet 34.

Referring now to FIG. 2, there is shown glass envelope 10 having bulbous portion 12 and tubular portion 14 whose lower section has been pressed as previously described to form a press seal 40. Press seal 40 encloses lead-in conductors 20, 22, 24 and 26 and exhaust tube 30 which now provides fluid communication between the interior of envelope 10 and the exterior thereof. Lead-in conductors 20, 22, 24 and 26 are retained in a spaced-apart configuration by bridge 28. Tube outlet 34 is unobstructed to provide fluid communication between tube 32 and the interior of envelope 10.

Following the press-sealing step described above, inlet 32 of exhaust tube 30 is connected to a vacuum pump (not shown) and the gaseous contents of envelope 10 are removed by applying a vacuum thereto. Inlet 32 of exhaust tube 30 is then removed from the vacuum pump and is exposed to a source of inert gas. The pressure difference between the pressure of the source of the inert gas and the pressure of the interior of envelope 10 which is under vacuum causes the inert gas to flow into the interior of envelope 10. After envelope 10 is filled with inert gas, heat is applied to exhaust tube 30 immediately adjacent press-sealed base 40 to remove the portion of exhaust tube 30 that extends exteriorly of press-sealed base 36 and to close exhaust tube 30 thereby obstructing the fluid communication between the interior and exterior of envelope 10 through exhaust tube 30 and sealing the inert gas in the interior of envelope 10.

One disadvantage of the prior methods including the prior method described above is that they utilize a two-step process to replace undesirable gases in the envelope with inert gases, namely, evacuating the undesirable gases by a vacuum pump and exposing the evacuated envelope to a source of inert gases. Another disadvantage is that the sealing provided by the press-sealed base around the exhaust tube is not leak proof, and with the passage of time, inert gas escaped from the interior of the envelope through an escape passage existing between the exhaust tube and the press-sealed base.

The above disadvantages are overcome by the present invention which provides a one-step process for displacing the undesirable gases from the glass envelope and replacing them with inert gases, eliminates the problem of gas leakage between the exhaust tube and the press-sealed base, and provides a positive injection of inert gas to the interior of the glass envelope whereby the amount of inert gas trapped within the envelope is higher than the amount achieved by the prior art processes.

These and other advantages of the present invention will become apparent from the following description.

SUMMARY OF THE INVENTION

An incandescent lamp and a method of manufacturing the lamp is disclosed. A mount assembly comprising at least one filament, corresponding lead-in conductors and a bridge for securely retaining the lead-in conductors in a spaced apart relationship to each other is placed in a light transmitting envelope. The light transmitting envelope includes a bulbous portion and a tubular portion. The ends of the lead-in conductors that are not connected to the filament or filaments extend through an open end of the tubular section to the exterior of the envelope. An injection tube is inserted into the interior of the tubular section. Heat is applied to the tubular section and an inert gas is injected into the interior of the envelope via the injection tube to displace undesirable gases from the interior of the envelope and to fill the interior with inert gas. A portion of the tubular section is then pressed to form a press-sealed base around the lead-in conductors and the injection tube and above the injection tube outlet to seal the lamp and to prevent the escape of the inert gas from the interior of the envelope.

The portion of the injection tube that extends to the exterior of the press sealed base is removed. The ends of the lead-in conductors that extend to the exterior of the envelope are reverse bent over the sides of the press-sealed base and a sleeve is placed over the tubular section of the envelope. The lamp may be placed in a socket having appropriate electrical connections which transmit electricity to the filament or filaments through the lead-in conductors to illuminate the lamp.

BRIEF DESCRIPTION OF THE DRAWINGS

For a detailed description of the invention, reference will now be made to the accompanying drawings, wherein.

DETAILED DESCRIPTION OF THE INVENTION

According to the present invention, an incandescent lamp and a method of manufacturing the same are disclosed. A preassembled mount assembly comprising one or more filaments connected to corresponding pairs of lead-in conductors, and a bridge for maintaining the lead-in conductors in a spaced-apart relationship is inserted into the interior of a light transmitting envelope having a bulbous portion and a tubular portion. A tube is inserted axially into the interior of the tubular portion of the envelope. While heat is applied to the tubular portion of the envelope, an inert gas is injected into the interior of the envelope through the tube to displace undesirable gases therefrom and to replace said undesirable gases with the inert gas. The undesirable gases flow out of the envelope through the cylindrical annulus provided between the tubular portion of the envelope and the injection tube. Then, press jaws compress the lower section of the tubular portion to form a press-sealed base which encloses the tube and extends beyond the outlet of the tube. The press-sealed base encloses the conductors and provides a seal for trapping the inert gas in the envelope.

Figure 3:
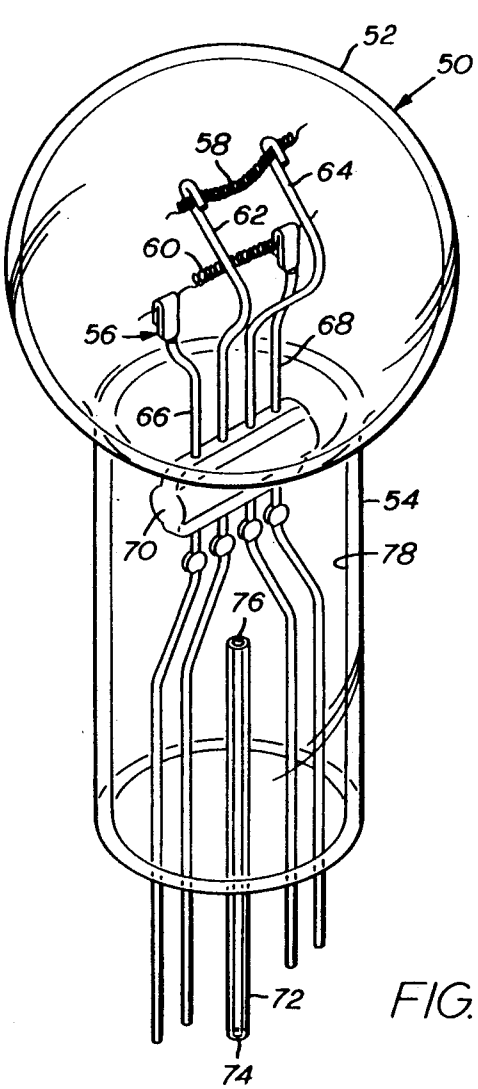
FIG. 3 is a perspective view of an incandescent lamp illustrating the process of the present invention.

The invention will now be described in connection with a preferred embodiment thereof. Referring now to FIG. 3, there is shown a preformed light transmitting envelope 50 made out of glass such as fused quartz or high silicon glass. Envelope 50 includes a bulbous portion 52 and a tubular or neck portion 54. A mount assembly 56 is inserted into the interior of envelope 50. Mount assembly 56 includes a first filament 58 and a second filament 60. A first lead-in conductor 62 is connected to one end of first filament 58 and a second lead-in conductor 64 is connected to the other end of filament 58. Similarly, a third lead-in conductor 66 is connected to one end of second filament 60 and a fourth lead-in conductor 68 is connected to the other end of second filament 60. Lead-in conductors 62, 64, 66 and 68 pass through the interior of tubular portion 54 and extend to the exterior of envelope 50. A bridge 70 placed below filaments 58 and 60 maintains lead-in conductors 62, 64, 66 and 68 in a spaced-apart relationship to each other.

Filaments 58 and 60 are constructed of tungsten or similar filament material well known in the art of incandescent lamps. Lead-in conductors 62, 64, 66 and 68 are lead-in wires suitable for transmitting electricity to filaments 58 and 60 and are constructed of conductive materials well known in the art. Bridge 70 is constructed of hard plastic material capable of withstanding the temperature conditions encountered in incandescent lamps and is also well known in the art.

An injection tube 72 made out of glass or similar material is axially placed in tubular portion 54 and extends from the interior of tubular portion 54 to the exterior of envelope 50. Injection tube 72 has an inlet 74 and an outlet 76.

Heat is applied to tubular portion 54 to make it sufficiently soft for press sealing as hereinafter described, while inert gas such as argon, nitrogen or a combination thereof is injected into the interior of envelope 50 through injection tube 72. The preferred inert gas composition is 80 percent argon and 20 percent nitrogen. The inert gas is supplied by an inert gas source (not shown) which is connected to inlet 74 of injection tube 72. The injected inert gas displaces other gases that are present in the interior of envelope 50 and the displaced gases flow out of envelope 50 through annular cavity 78 which is formed between injection tube 72 and tubular portion 54. When all of the previously existing gases in the interior of envelope 50 are replaced with inert gas, press jaws (not shown) press the heated lower section of tubular portion 54 to form a press-sealed base (not shown) around lead-in conductors 62, 64, 66 and 68 and a portion of injection tube 72. A sufficient length of section of tubular portion 54 is pressed to form the press-sealed base so as to form a seal above outlet 76 of injection tube 72 to provide a seal between outlet 76 of tube 72 and the interior of bulbous portion 52. Heat is applied to tube 72 at the point where tube 72 extends outwardly beyond the press-sealed base (not shown) to remove the remaining portion of tube 72 that projects from the press-sealed base (not shown). The melting of tube 72 to effect the removal of the projecting portion thereof causes the tube 72 to collapse at that point and to provide an obstruction which prevents fluid communication between the interior of tube 72 enclosed within the press-sealed base and the exterior of the press-sealed base.

Figure 4:
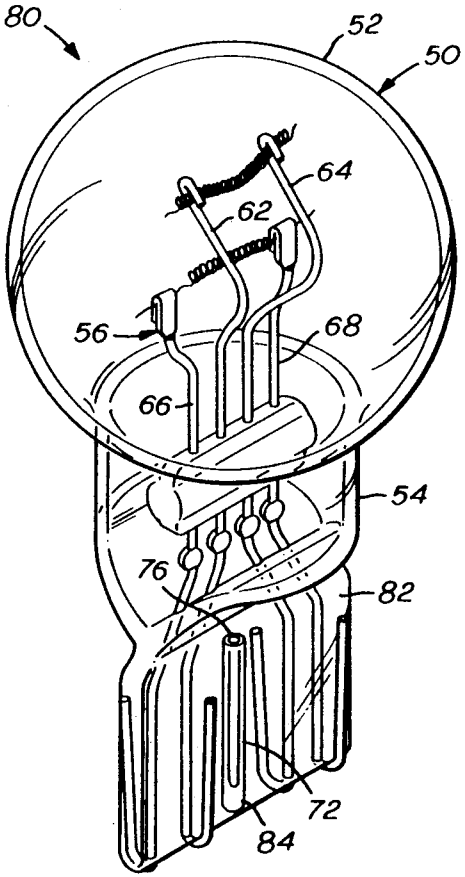
FIG. 4 is a perspective view of an incandescent lamp manufactured by the manufacturing process illustrated in FIG. 3 in accordance with the present invention.

Referring now to FIG. 4, there is shown an incandescent lamp 80 prepared in accordance with the present invention described above. Lamp 80 has an envelope 50 comprised of bulbous portion 52, tubular portion 54, and a press-sealed base 82 formed by pressing a section of tubular portion 54, as previously described. A mount assembly 56 is enclosed in the interior of lamp 80 which is filled with inert gas. Press-sealed base 82 encloses a section of lead-in conductors 62, 64, 66 and 68. The ends of lead-in conductors 62, 64, 66 and 68 extend to the exterior of press sealed base 82. A portion of injection tube 72 is embedded in press-sealed base 82. Press-sealed base 82 extends above outlet 76 of tube 72 whereby fluid communication between the remaining portion of tube 72 and the interior of envelope 50 is prevented. Furthermore, the remaining portion of tube 72 is obstructed at point 84 whereby fluid communication between the interior of the remaining portion of tube 72 and the exterior of lamp 80 is prevented. The interior of the remaining portion of tube 72 forms a hollow space in press-sealed base 82.

Figure 2:
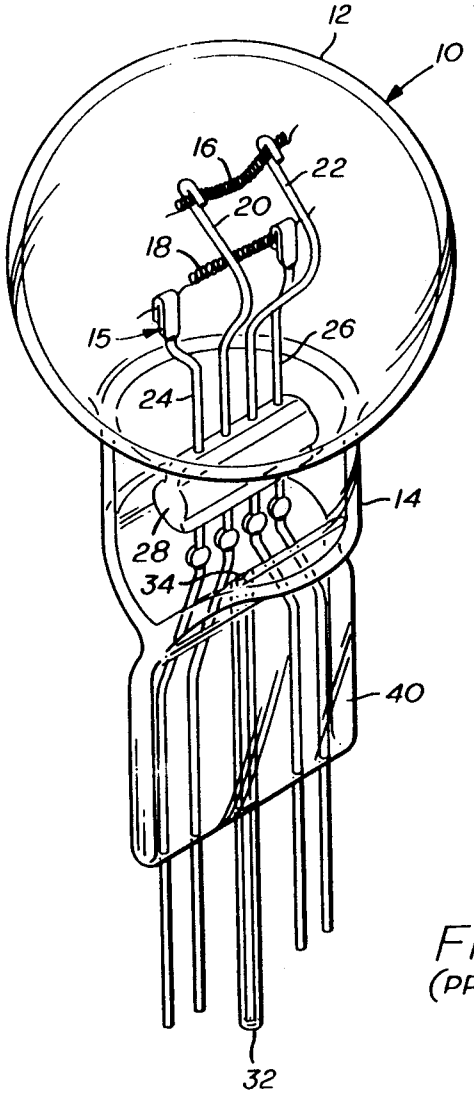
FIG. 2 (PRIOR ART)
FIG. 2 is a perspective view of an incandescent lamp manufactured by the prior art manufacturing process being illustrated in FIG. 1.
Figure 1:
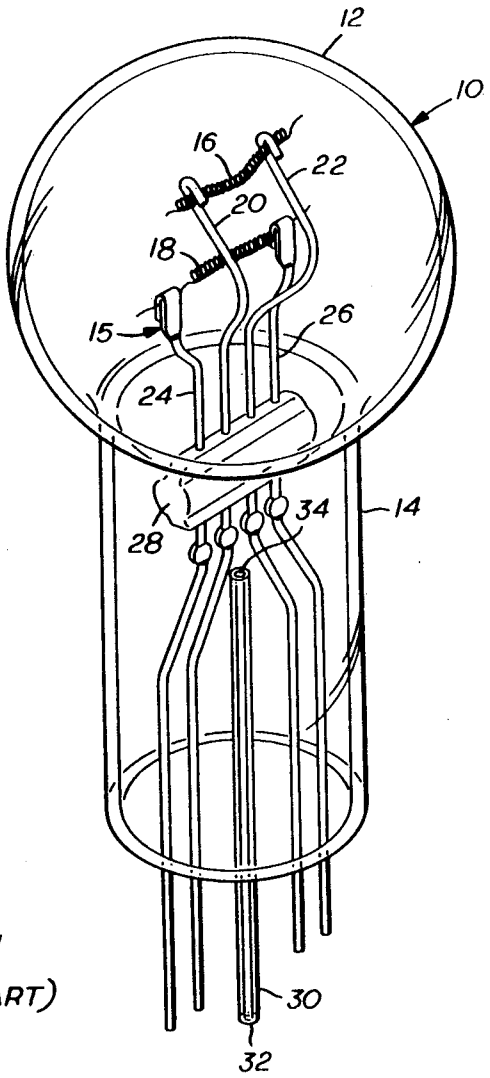
FIG. 1 (PRIOR ART)
FIG. 1 is a perspective view of an incandescent lamp illustrating a prior art manufacturing process.
Figure 5:
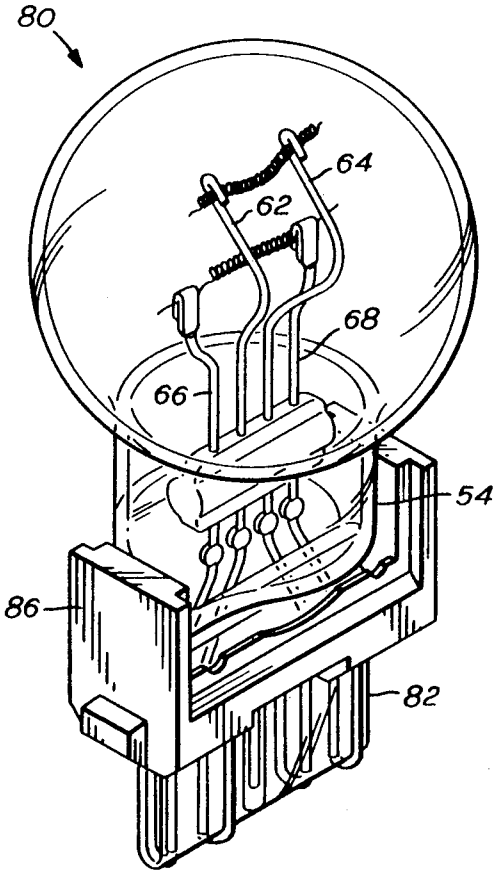
FIG. 5 is a perspective view of the incandescent lamp shown in FIG. 4 having a collar and reverse bent lead-in conductors for insertion in a socket.

Referring now to FIG. 5, there is shown lamp 80 of FIG. 4 suitable for insertion in a socket. A collar 86 is placed over tubular portion 54. The sections of lead-in conductors 62, 64, 66 and 68 that extend to the exterior of lamp 80 are reverse bent over the sides of press-sealed base 82. Lamp 80 may then be inserted into a socket wherein the necessary electrical connections are made to cause the filaments in the lamp to glow thereby illuminating the lamp.

The method of the present invention that utilizes the step of displacing a first gas of one composition by injecting into the interior of the lamp a second gas of another composition such as an inert gas and sealing the lamp to trap the second gas in the interior of the lamp may be used with any incandescent lamp where such steps are applicable. The present invention is more applicable in the manufacture of incandescent lamps having a press-sealed base and, most applicable, in the manufacture of miniature incandescent lamps having a press-sealed base for use in automobiles or the like.

Although the invention is described herein with respect to a preferred embodiment and a preferred process, modifications thereof can be made by one skilled in the art without departing from the spirit of the invention and the details hereof are not to be construed as limitations except to the extent indicated in the following claims.

What is claimed is:

1. A method of manufacturing an incandescent lamp having a bulbous portion and a base portion, comprising the steps of :

providing a tube extending through the base portion, the tube having a tube inlet and a tube outlet;

injecting a first gas into the lamp to displace substantially all of a second gas; and press sealing the base portion to trap the first gas within the bulbous portion and to prevent the first gas from escaping from the interior of the bulbous portion to the exterior of the lamp.

2. A method according to claim 1 wherein the first gas is injected from the lamp through the tube and the second gas is displaced from the lamp by flowing around the tube.

3. A method according to claim 1 further including the step of closing the tube outlet following the injecting step to prevent the escape of the first gas from the interior of the bulbous portion to the exterior of the lamp through the tube.

4. A method according to claim 1 wherein the press sealing step includes the step of closing the tube outlet following the injecting step to prevent the escape of the first gas from the interior of the lamp to the exterior of the lamp through the tube.

5. A method of manufacturing an incandescent lamp having a bulbous portion and a base portion, comprising the steps of:

providing a tube extending through the base portion, the tube having a tube inlet and a tube outlet;

injecting a first gas into the lamp to displace substantially all of a second gas;

obstructing the tube inlet following the injection step; and press sealing the base portion to trap the first gas within the bulbous portion and to close the tube outlet.

6. A method according to claim 5 wherein the obstructing step includes the step of melting a portion of the tube to block the tube inlet.

7. A method according to claim 1 wherein the press sealing step includes the steps of sealingly enclosing a portion of the tube and sealingly obstructing the outlet of the tube by the base portion.

* * * * *